US005119139A

United States Patent [19]

Torisawa

[11] Patent Number: 5,119,139

[45] Date of Patent: Jun. 2, 1992

[54] ELECTROPHOTOGRAPHIC IMAGE FORMING APPARATUS HAVING MULTIPLE PRINTING STATIONS

[75] Inventor: Yoshihiro Torisawa, Tomita, Japan

[73] Assignee: Tokyo Electric Co., Ltd., Tokyo, Japan

[21] Appl. No.: 454,459

[22] Filed: Dec. 21, 1989

[30] Foreign Application Priority Data

Jan. 6, 1989 [JP] Japan ..... 64-892
Apr. 13, 1989 [JP] Japan ..... 1-43191

[51] Int. Cl.[5] ..... G03G 15/14
[52] U.S. Cl. ..... 355/272; 355/273
[58] Field of Search ..... 355/272, 273, 277, 275, 355/281, 327, 212

[56] References Cited

U.S. PATENT DOCUMENTS

| | | | |
|---|---|---|---|
| 3,966,199 | 6/1976 | Silverberg | 355/217 |
| 4,162,843 | 7/1979 | Inoue et al. | 355/327 |
| 4,531,828 | 7/1985 | Hoshino | 355/272 X |
| 4,714,939 | 12/1987 | Ahern et al. | 355/275 |
| 4,742,371 | 5/1988 | Furata et al. | 355/327 |
| 4,887,101 | 12/1989 | Hirose et al. | 355/327 X |

FOREIGN PATENT DOCUMENTS

| | | | |
|---|---|---|---|
| 3630349 | 3/1987 | Fed. Rep. of Germany . | |
| 0080080 | 7/1981 | Japan | 355/273 |
| 0154774 | 11/1981 | Japan | 355/275 |

OTHER PUBLICATIONS

Patent Abstracts of Japan, vol. 9, No. 6 (P-326) [1729], 11 Jan. 1985; & JP-59154465 (Ricoh) Sep. 3, 1984.
Patent Abstract of Japan vol. 9, No. 44 (P-337) [1767], 23 Feb. 1985; & JP-A-59184377 (Fuji Shashin Film) Oct. 19, 1984.
Patent Abstracts of Japan vol. 3, No. 28 (E-96) (63), 9 Mar. 1979; & JP-A-546559 (RICOH) Jan. 18, 1979.

*Primary Examiner*—A. T. Grimley
*Assistant Examiner*—Nestor R. Ramirez
*Attorney, Agent, or Firm*—Oblon, Spivak, McClelland, Maier & Neustadt

[57] ABSTRACT

In the image forming apparatus of the present invention, printing stations are provided in positions opposed to an endless paper conveying belt, and an electric charger is disposed close to a conveyance roller and on a downstream side of the conveyance roller with respect to a conveyance direction, which conveyance roller is disposed in a conveyance start position of the paper conveying belt, to maintain the surface potential of each recording paper in good condition, whereby it is made possible to prevent the deterioration of the image quality, diminish the power consumption and attain a reduction in size of the apparatus.

6 Claims, 3 Drawing Sheets

ELECTROPHOTOGRAPHIC IMAGE FORMING APPARATUS HAVING MULTIPLE PRINTING STATIONS

FIELD OF THE INVENTION AND RELATED ART STATEMENT

The present invention relates to an electrophotographic type image forming apparatus to make printing for a printing paper being conveyed in an electrostatically adsorbed state on a paper conveying belt.

An example of a conventional image forming apparatus will first be described with reference to FIG. 3. In a conventional image forming apparatus 1, an endless paper conveying belt 2 formed of a dielectric is stretched horizontally within the apparatus, and four printing stations $3_1$ to $3_4$ of the same structure are disposed side by side along the upper surface of the belt 2.

The structure of the printing stations $3_1$ $3_4$ will now be explained. On the upper surface of the paper conveying belt 2 there are disposed photosensitive drums 4 side by side, and above and before each of the photosensitive drums 4 there are disposed side by side a photoscanner 5 and a developing unit 6, respectively. On the reverse side of the paper conveying belt 2 there are disposed transfer rollers 8 as transfer units in positions opposed to the photosensitive drums 4, with a power source 7 being connected to the transfer rollers 8. Further, a toner cleaner 9 and a charger 10 are disposed along the peripheral surface of each photosensitive drum 4 in the area from the transfer portion up to the scanning portion. At an end portion on the conveyance start side of the paper conveying belt 2 there are disposed a conveyance roller 11 and a charger 12 above and below, respectively, in an opposed relation to each other. On the other hand, at the end portion on the conveyance end side of the belt 2 there is disposed a fixing unit 13 in an opposed relation to the belt end portion. The developing unit 6 contains toners (not shown) of, for example, yellow, magenta, cyan and black in the printing stations $3_1$ to $3_4$, respectively.

In the above construction, first a recording paper 14 fed into the apparatus is pressed by the conveyance roller 11 against the upper surface of the paper conveying belt 2 which has been electrified by a discharging action of the charger 12, and thereby attracted to the belt upper surface electrostatically. With movement of the paper conveying belt 2, the recording paper 14 thus attracted to the belt is conveyed to each of the printing stations $3_1$ to $3_4$. In each of the printing stations $3_1$ to $3_4$, laser light is emitted from the photo scanner 5 to the photosensitive drum 4 which has been electrified by a discharging action of the charger 10, to scan an electrostatic latent image, to which latent image is applied a toner when the photosensitive drum 4 passes the developing unit 6 to form a monochromatic image. Then, by a discharging action of the transfer roller 8 the monochromatic image is transferred to the recording paper 14 being carried on the paper conveying belt 2. In this way, monochromatic images are lap-printed successively onto the recording paper 14, which paper is then pressed and heated by the fixing unit 13 and discharged out of the apparatus. Printing is now over. The photosensitive drum 4 after image transfer then passes the toner cleaner 9 and the charger 10, whereby the residual toner is removed and the drum is re-electrified, ready for the next printing.

In the image forming apparatus 1, as set forth above, the recording paper 14 is conveyed while being attracted electrostatically to the paper conveying belt 2. To ensure this attraction, the paper 14 is pushed against the paper conveying belt 2 by means of the conveyance roller 11. At this time, however, the electric charge on the belt 2 flows out from the roller 11, with the result that the surface potential of the paper 14 lowers. Therefore, in the conventional image forming apparatus 1 it is necessary to use a discharger for image transfer in addition to the charger 12 for the paper conveying belt 2, and the four transfer rollers 8 are provided. Consequently, the power consumption of the image forming apparatus 1 is large, so the power source 7 is large in size, and an insulation distance is required between adjacent transfer rollers 8. Further, it is difficult to reduce the size of the apparatus because of a large number of components.

OBJECTS AND SUMMARY OF THE INVENTION

It is the first object of the present invention to provide an image forming apparatus capable of effecting good transfer even in the absence of transfer rollers in printing stations.

It is the second object of the present invention to diminish the power consumption.

It is the third object of the present invention to provide a small-sized image forming apparatus.

It is the fourth object of the present invention to attain a strong adhesion of a recording paper to a paper conveying belt without lowering the surface potential of the paper.

Other objects of the present invention will become apparent from the following description.

According to the present invention, in an electrophotographic type image forming apparatus having at least one printing station in a position opposed to an endless paper conveying belt stretched in the interior of the apparatus, a charger is disposed close to a conveyance roller and on a downstream side of the conveyance roller with respect to a conveyance direction which conveyance roller is disposed in a conveyance start position of the paper conveying belt opposedly to the belt. By this arrangement, a recording paper positioned on the paper conveying belt by the conveyance roller is electrified by the charger and reaches the printing station. Since the surface potential of the recording paper does not lower, the transfer of image can be performed by utilizing the surface potential and it is possible to omit a discharger in the printing station.

DETAILED DESCRIPTION OF PREFERRED EMBODIMENTS

Figure 1:
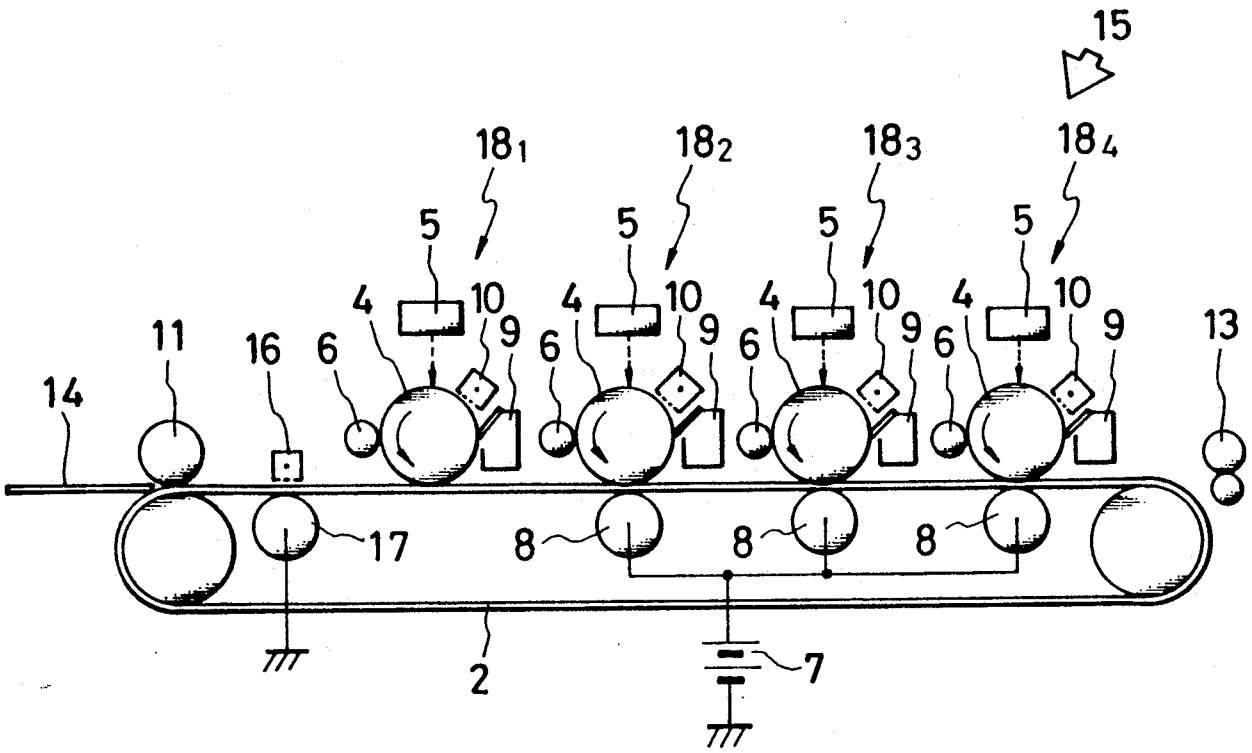
FIG. 1 is a longitudinal sectional view showing the first embodiment of the present invention.

The first embodiment of the present invention will now be described with reference to FIG. 1. In a color printer which is an image forming apparatus 15 according to this embodiment, a discharger 16, which also serves as an electric charger, is disposed behind a conveyance roller 11, and in a position opposed to the discharger there is disposed a counter electrode 17 through a paper conveying belt 2. And in a first printing station $18_1$ there is omitted a transfer roller 8. Other constructional points are the same as in the foregoing conventional image forming apparatus 1. Since the paper conveying belt 2 has insulation properties, the conveying roller 11 is insulated from the frame ground (earth).

In the image forming apparatus 15 of the above construction, a recording paper 14 fed into the apparatus is held under pressure between the conveying roller 11 and the paper conveying belt 2 and thereby positioned. In this state the paper 14 is electrified by a discharging action of the discharger 16 and thereby attracted to the belt 2. This electrostatic attraction is attained by an electric charge counter to that on the surface of the recording paper 14 being induced on the counter electrode 17 side opposed to the discharger 16 through the belt 2. Then, in the same manner as in the foregoing conventional image forming apparatus 1 a monochromatic image is lap-printed in each Of printing stations $18_1$ to $18_4$ to form a color image. In this image forming apparatus 15, the first printing station $18_1$ is not provided with a transfer roller for the following reason. After the recording paper 14 is electrified directly by the discharger 16, the surface thereof does not come into abutment with any member and is therefore held at a high potential, and this surface potential permits the transfer of a toner image onto the paper. Besides, since the paper 14 is attracted to the paper conveying belt 2 by virtue of a strong attraction, its fore end is prevented from floating from the belt 2, so there is no fear of image disturbance or jamming.

All the transfer rollers 8 can be omitted by improving the output of the discharger 16 and the insulation of the printing stations $18_1$ to $18_4$.

Further, even when the working atmosphere is in a high humidity condition, since the conveyance roller 11 which is in contact with the recording paper 14 is insulated from the frame ground, even in the event of slight electroconductivity developed on the surface of the paper 14, it is impossible that the electric charge imposed thereon by the discharger 16 will flow out to the frame ground through the conveyance roller 11. That is, the surface of the paper 14 after being electrified is maintained at a high potential.

Figure 2:
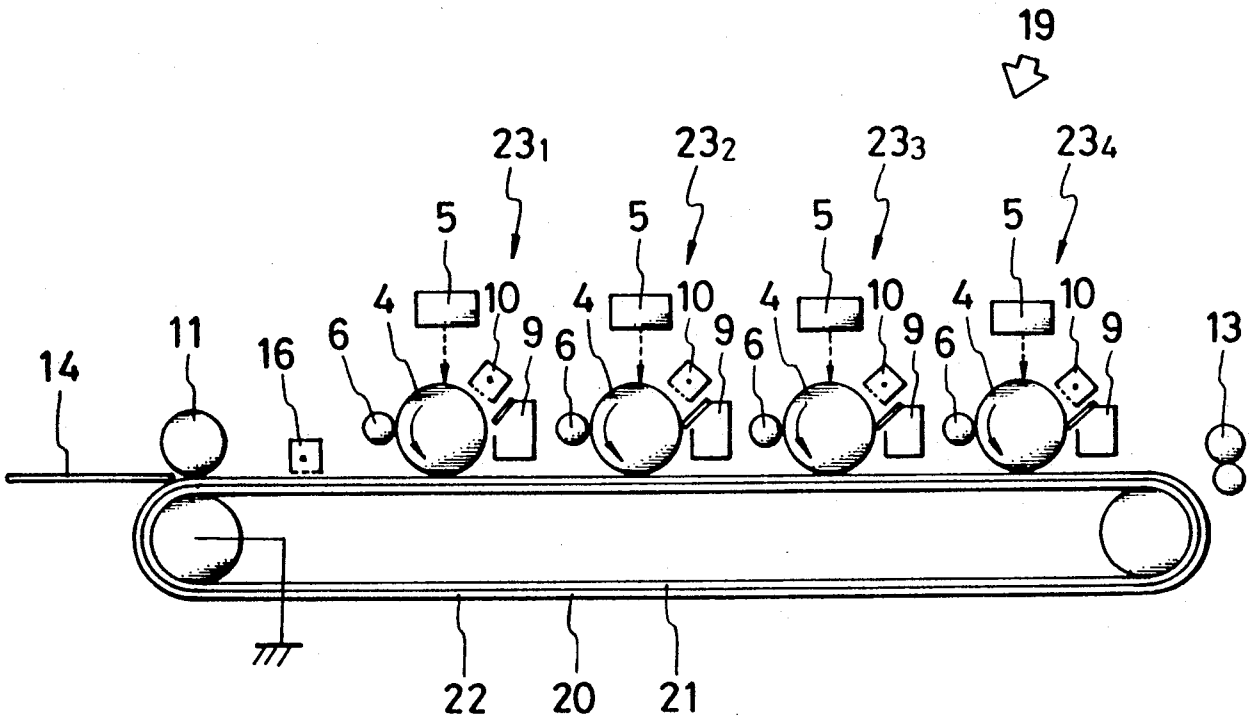
FIG. 2 is a longitudinal sectional view showing the second embodiment of the present invention.
Figure 3:
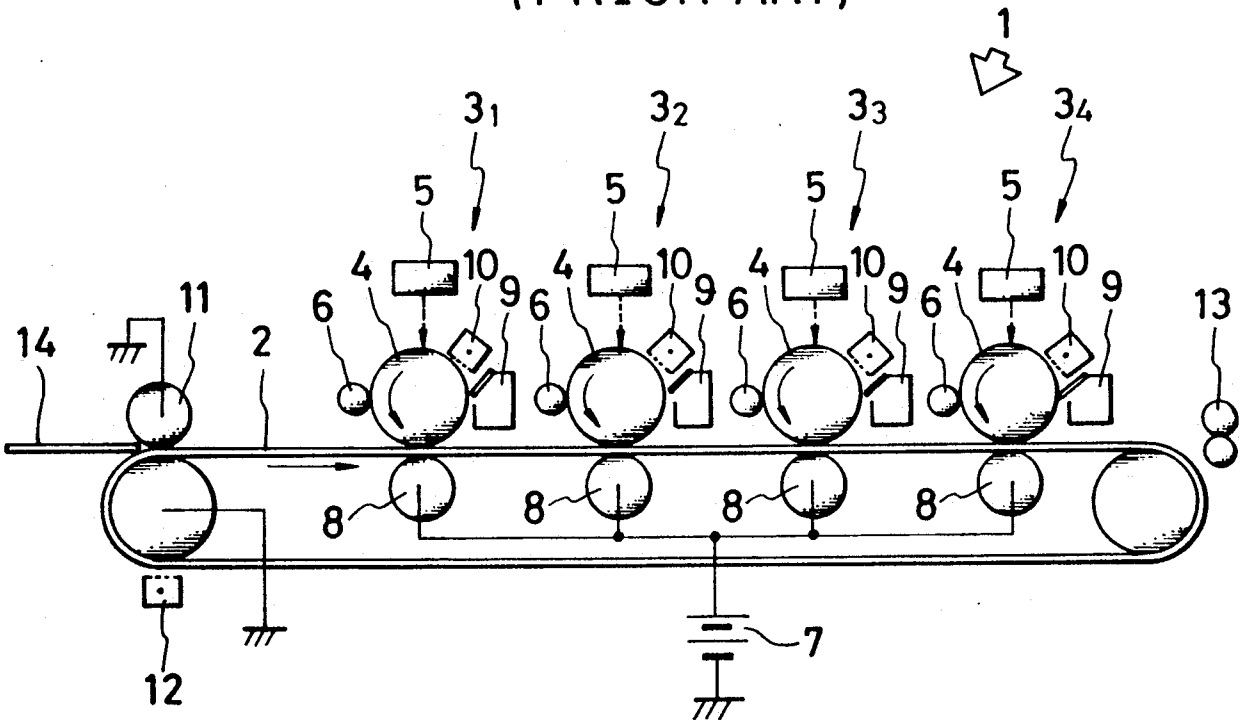
FIG. 3 (PRIOR ART)
FIG. 3 is a longitudinal sectional view showing the prior art.

The second embodiment of the present invention will now be described with reference to FIG. 2. In a color printer which is an image forming apparatus 19 according to this embodiment, there is used a paper conveying belt 22 having a dielectric layer 20 as a surface layer and a conductive layer 21 as a reverse-side layer, and none of printing stations $23_1$ to $23_4$ used in this embodiment are provided with the transfer rollers 8, and the counter electrode 17 is omitted. Other constructional points are the same as in the image forming apparatus of the previous embodiment.

In such construction, the image forming apparatus 19 functions in the same manner as the image forming apparatus 15. In this image forming apparatus 19, a potential sufficient to carry out the image transfer four times is provided to the recording paper 14 by the discharger 16. Further, since the surface potential of the paper 14 is maintained in good condition by the conductive layer 21 positioned on the reverse side of the paper conveying belt 22, all the transfer rollers 8 are omitted.

Although in the above embodiments the image forming apparatus 15 and 19 are used as color printers provided with plural printing stations $18_1$ to $18_4$ and $23_1$ to $23_4$, respectively, the present invention is not limited thereto, but is applicable also to a single color printer having only one printing station.

Also in this case, since the dielectric layer 20 of the paper conveying belt 22 exhibits a high insulation property, the conveyance roller 11 is insulated from the frame ground and the surface potential of the paper 14 once electrified is maintained in good condition.

What is claimed is:

1. In an electrophotographic type image forming apparatus having at least one printing station in a position opposed to an endless paper conveying belt stretched in the interior of the apparatus, wherein an electric charger is disposed close to a conveyance roller and on a downstream side of said conveyance roller with respect to a conveyance direction, and said conveyance roller is disposed in a conveyance start position of said paper conveying belt in a position opposed to said belt;

wherein said conveyance roller comprises means for pressing a recording paper to a pressed state against an upper surface of said paper conveying belt, and said electric charger comprises means for attracting said recording paper to said paper conveying belt to maintain said recording paper in said pressed state after said paper has been pressed against said upper surface of said conveying belt by said conveyance roller.

2. An image forming apparatus according to claim 1, wherein a plurality of printing stations are disposed along said paper conveying belt, of which at least a first printing station is not provided with a transfer roller.

3. An image forming apparatus according to claim 1, wherein a plurality of printing stations are disposed along said paper conveying belt, none of said printing stations being provided with a transfer roller.

4. An image forming apparatus according to claim 1, wherein a counter electrode connected to a frame ground is disposed in opposed relation to said electric charger through said paper conveying belt.

5. An image forming apparatus including:

an endless paper conveying belt having a dielectric layer as a surface layer and an electroconductive layer as a reverse-side layer;

an electric charger disposed close to a conveyance roller and on a downstream side of said conveyance roller with respect to a conveyance direction, said conveyance roller being disposed in a conveyance start position of said paper conveying belt; and a plurality of printing stations not provided with transfer rollers, said printing stations being disposed in opposed relation to said paper conveying belt;

wherein said conveyance roller comprises means for pressing a recording paper to a pressed state against an upper surface of said paper conveying belt, and said electric charges comprises means for attracting said recording paper to said paper conveying belt to maintain said recording paper in said pressed state after said paper has been pressed against said upper surface of said conveying belt by said conveyance roller.

6. An image forming apparatus according to claim 1 or claim 5, wherein said conveyance roller is insulated from a frame ground.

* * * * *